US006971445B2

(12) United States Patent
Lamich et al.

(10) Patent No.: US 6,971,445 B2
(45) Date of Patent: Dec. 6, 2005

(54) HEAT EXCHANGER AND METHOD OF PRODUCTION

(75) Inventors: Bernhard Lamich, Esslingen (DE); Stanislaus Lesjak, Filderstadt (DE); Viktor Brost, Aichtal (DE)

(73) Assignee: Modine Manufacturing Company, Racine, WI (US)

( * ) Notice: Subject to any disclaimer, the term of this patent is extended or adjusted under 35 U.S.C. 154(b) by 0 days.

(21) Appl. No.: 10/632,285

(22) Filed: Aug. 1, 2003

(65) Prior Publication Data

US 2004/0069468 A1 Apr. 15, 2004

(30) Foreign Application Priority Data

Aug. 17, 2002 (DE) ..... 102 37 769

(51) Int. Cl.[7] ..... F28F 9/02
(52) U.S. Cl. ..... 165/175; 165/153; 165/173
(58) Field of Search ..... 165/149, 153, 165/173, 175

(56) References Cited

U.S. PATENT DOCUMENTS 4,938,284 A * 7/1990 Howells ..... 165/149
5,152,339 A * 10/1992 Calleson ..... 165/173
5,236,042 A * 8/1993 Kado ..... 165/149
5,297,624 A * 3/1994 Haussmann et al. ..... 165/173
5,363,911 A * 11/1994 Velluet et al. ..... 165/173
5,450,896 A * 9/1995 Bertva et al. ..... 165/173
5,816,321 A * 10/1998 Wijkstrom ..... 165/173
5,836,384 A * 11/1998 Wijkstrom et al. ..... 165/173
5,899,263 A * 5/1999 Tokutake ..... 165/173
5,904,206 A * 5/1999 Kroetsch ..... 165/173
6,289,979 B1 * 9/2001 Kato ..... 165/173

FOREIGN PATENT DOCUMENTS

| | | |
|---|---|---|
| DE | 1277282 | 9/1968 |
| DE | 7229162 | 8/1972 |
| DE | 3834822 | 4/1990 |
| DE | 19536999 | 4/1996 |
| DE | 19722098 | 9/1998 |
| EP | 0863376 | 9/1998 |
| EP | 0882940 | 12/1998 |
| EP | 1004841 | 5/2000 |

* cited by examiner

*Primary Examiner*—Leonard R. Leo
(74) *Attorney, Agent, or Firm*—Wood, Phillips, Katz, Clark & Mortimer

(57) ABSTRACT

A heat exchanger having a manifold defined by a plurality of connected closure pieces. A corner of the manifold is defined by the connected joint of three closure pieces, where one closure piece has a bent edge abutting an end of a second closure piece adjacent a generally flat section of a third closure piece. The bent edge of the one closure piece adjacent the manifold corner is a bend in a thin portion of the one closure piece, where the thin portion has a sheet thickness which is less than the sheet thickness of the adjacent portions of the one closure piece. Multiple corners of the manifold can be formed in this manner by thinning the thin and bending the portion, then connecting the closure pieces using solder to form a seal in the open cross section at the corners.

11 Claims, 7 Drawing Sheets

HEAT EXCHANGER AND METHOD OF PRODUCTION

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention is directed toward heat exchangers, and particularly toward heat exchanger manifolds having corners therein and the manufacture of such manifolds.

BACKGROUND OF THE INVENTION AND TECHNICAL PROBLEMS POSED BY THE PRIOR ART

Heat exchangers are known of a variety of configurations, including EP 1 004 841 A2, which has a plurality of tubes connected to a manifold which is formed of a header, closure caps and a tank closure, the individual parts being produced from solder-coated aluminum sheets, which are assembled into a heat exchanger. Process-reliable manufacture of such heat exchangers may be difficult, however, because the connection of the components, particularly at corners formed of three parts, is difficult to manage.

Heat exchangers for vehicles, such as radiators, have been state-of-the-art for many decades and have proven themselves to be reliably producible and functionally reliable as well. An example is described in German Utility Model 7 229 162, in which the tube bottom is divided into several small segments.

However, the collecting tanks or manifolds are often made of plastic and fastened mechanically on the peripheral edge of the bottom of the tubes. Since such tube bottoms have a distinct protrusion above the heat exchanger core (generally consisting of flat tubes and corrugated ribs), such structures can require relatively significant incorporation space, which can be undesirable in instances where space is limited, such as in vehicle engine compartments. Recycling is also hampered, because of the use of different material.

There are and have been many proposals, and heat exchangers consisting completely of aluminum are also already in use for vehicles, in which the weight and the required incorporation space of vehicle heat exchangers have been further reduced by omitting the tube bottom. DE 38 34 822 A1 is representative in this regard. Such solutions require deformation of the ends of the flat tubes in order to be able to join them to the walls of the collecting tank or manifold in sealed fashion. The manufacturing process in such heat exchangers can still, however, be problematic, particularly the tight solder connection, and the manufacturing cost caused by deformation of the tube ends. The necessary use of high-grade materials with very good deformation properties also cannot be overlooked.

It has been proposed, including in DE 197 22 098 A1, to lengthen the side parts on both ends and to close the front ends of the collecting tanks with these extensions. An additional reduction in the number of individual parts was achieved with this expedient, and a costly deep drawing die need not be prescribed for production of the collecting tanks, because the collecting tanks need have only two bevelings or flanges running in the longitudinal direction, which can be accomplished with a relatively simple bending tool.

A heat exchanger with collecting tanks have a rectangular profile in cross section is described in DE 1 277 282. The flat tube ends are deformed in order to be able to solder them in the profile, and the end openings of the collecting tanks are closed by individual caps. A tube bottom is not required there as an individual part.

A coolant condenser is described in DE 195 36 999 A1, which also shows caps closing the front openings of the collecting tanks. Since the collecting tanks and the coolant condenser are in two parts, one part can be viewed as the tube bottom, since it has openings in which the ends of the flat tubes are arranged, and the other part can be viewed as the tank. Both parts are joined on a common soldering edge.

Side parts, whose ends each extend in a slit provided on the ends of the collecting tubes, are shown in EP 0 882 940 A2, in which a condenser of an air conditioner is described. However, the ends do not close the entire cross section of the collecting tubes. A situation is only achieved in which the integrity of the heat exchanger is improved. Since the collecting tanks are designed as tubes, this heat exchanger has no tube bottom as an individual part, as stated in the preamble.

This developmental trend briefly sketched on the example of condensers, however, has not been pursued in heat exchangers for vehicles, like water coolers or charge-air coolers, since the direction described further above is being pursued there and the tube bottom has been abandoned, so that a developmental direction that has also long been known has been resumed again and pursued.

The present invention is directed toward overcoming one or more of the problems set forth above.

SUMMARY OF THE INVENTION

In one aspect of the present invention, a vehicle heat exchanger is provided, including a plurality of flat tubes communicating with an enclosed space defined by a plurality of connected closure pieces. The tubes have open ends secured to and extending through tube openings in one of the closure pieces. A first corner of the defined space is defined by the connected joint of three of the closure pieces where a first of the closure pieces has a first bent edge abutting an end of a second of the closure pieces adjacent a generally flat section of a third of the closure pieces. The first bent edge of the first closure piece adjacent the first corner comprises a bend in a thin portion of the first closure piece. The thin portion has a sheet thickness which is less than the sheet thickness of the adjacent portions of the first closure piece.

In one form of this aspect of the invention, the first bent edge comprises a flange at generally right angles to a wall member of the first closure piece which defines a side of the defined space, and the flange is generally aligned with the generally flat section of the third closure piece.

In another form of this aspect of the invention, the one closure piece includes four side flanges extending generally in the direction of the tubes, wherein at least two of the flanges join at the first bent edge.

In still another form of this aspect of the invention, four corners of the defined space are each defined by the connected joint of three of the closure pieces. In this form, the first closure piece includes four side flanges extending generally in the direction of the tubes and joined in a rectangular configuration with four bent edges at the joining of the side flanges. Each of the four corners is defined by a connected joint of three of the closure pieces, one of which is one of the bent edges of the first closure piece. Each of the bent edges comprise a bend in a thin portion of the first closure piece having a sheet thickness which is less than the sheet thickness of the adjacent portions of the first closure piece. In further forms, the first closure piece is a header, other closure pieces are closure caps and a tank closure, and two side flanges on opposite ends of the header are fluid tight sealed to the first and second closure caps, respectively, along their length, and the other two side flanges are fluid tight sealed to the tank closure along their length, and the tank closure and the side flanges are fluid tight sealed.

In still further forms, the first bent edge at the thin portion of the first closure piece has an outer bending radii of 0.8 mm or less, the one of the closure pieces is a header, the plurality of connected closure pieces comprise a manifold, and/or the closure pieces are aluminum with a fluid tight seal at the first corner formed by solder.

In another aspect of the present invention, a method is provided for manufacturing a vehicle heat exchanger having a plurality of flat tubes having open ends secured to a manifold defined by connected closure pieces, the closure pieces being connected whereby a first corner of the manifold is defined by the connected joint of three of the closure pieces. The method includes the steps of (1) forming a thin portion of a first of the closure pieces with a sheet thickness which is less than the sheet thickness of the adjacent portions of the first closure piece, (2) deforming the first closure piece thin portion to form a first bent edge, and (3) connecting the closure pieces to form the manifold, wherein the first bent edge abuts an end of a second of the closure pieces adjacent a generally flat section of a third of the closure pieces.

In a further form of this aspect of the invention, the closure pieces are aluminum, and the connecting step comprises soldering the aluminum pieces together.

In a still further form of this aspect of the invention, the forming step includes reducing the sheet thickness at the thin portion by about ⅓ over the sheet thickness of the adjacent portions.

In yet another form of this aspect of the invention, a plurality of corners are defined by the connected joint of three of the closure pieces and the method includes, for each of the plurality of corners, (1) in at least one of the closure pieces forming a thin portion in an area to be at the connected joint defining the corner, wherein the thin portion for each corner has a sheet thickness which is less than the sheet thickness of the adjacent portions of the at least one closure piece, and (2) deforming the closure piece thin portion to form a bent edge, where the connecting step includes connecting the closure pieces to form the manifold with at least one of the bent edges abutting an end of a second of the closure pieces adjacent a generally flat section of a third of the closure pieces at each of the plurality of corners.

BRIEF DESCRIPTION OF THE DRAWINGS

The invention is described below in practical examples, for which purpose the accompanying figures are referred to. In the figures.

DETAILED DESCRIPTION OF THE INVENTION

Figure 1:
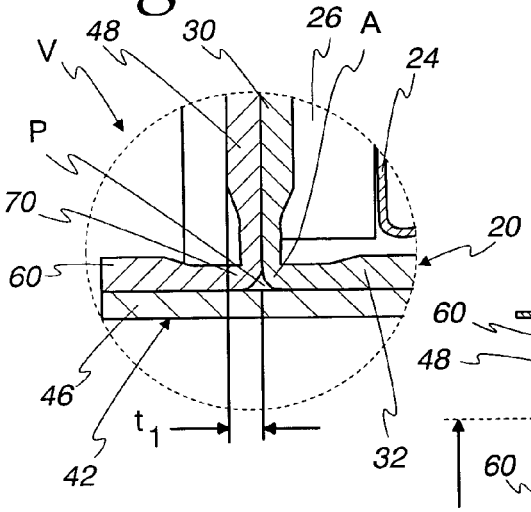
FIG. 1 is detail V of FIG. 2, illustrating in cross-section a corner of a manifold of a heat exchanger.
Figure 2:
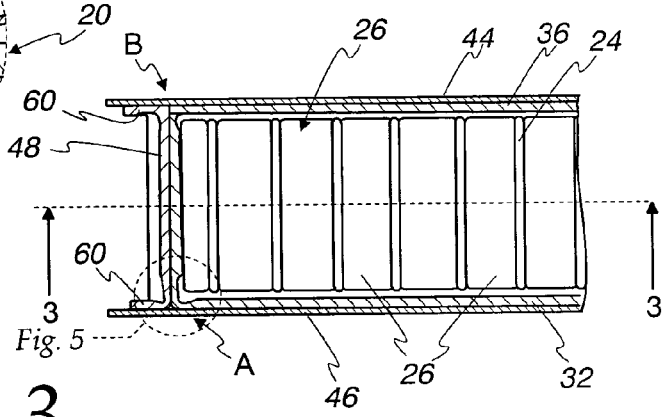
FIG. 2 is a top cross-sectional view of a portion of a heat exchanger according to one embodiment of the present invention, taken along line 2—2 of FIG. 3.
Figure 3:
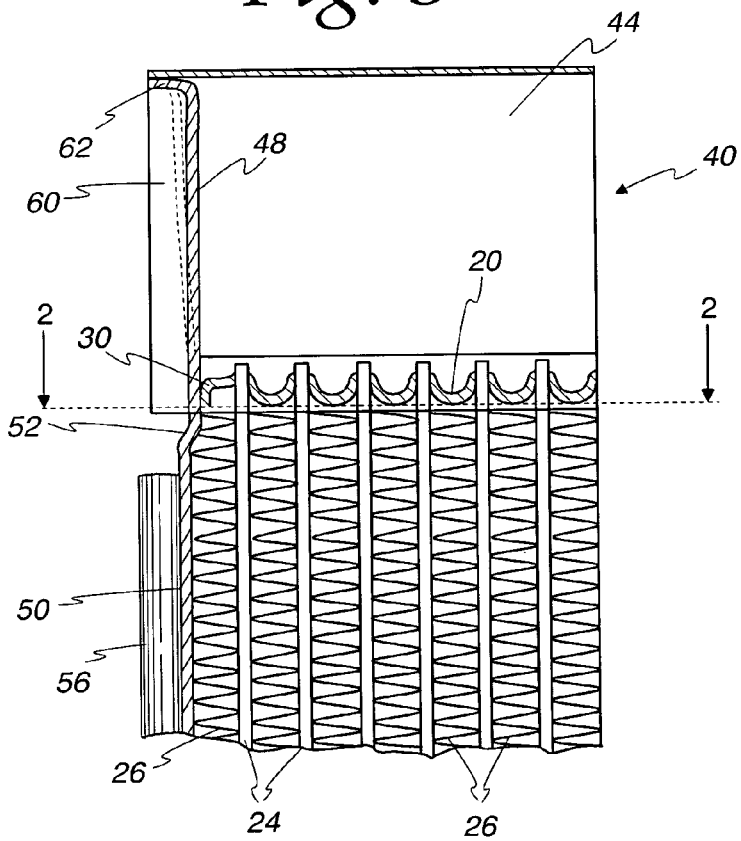
FIG. 3 is a side cross-sectional view of the heat exchanger of FIG. 2, taken along line 3—3 of FIG. 2.
Figure 4:
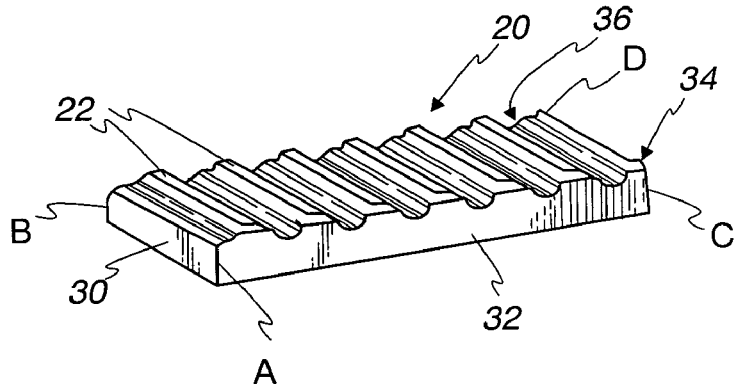
FIG. 4 is a perspective view of the header in the FIGS. 1–3 embodiment.

In the practical example of a heat exchanger 18 according to FIGS. 1 to 3, headers 20 (also known as header plates) may be provided such as shown in FIG. 4. Openings 22 suitable for connecting to the ends of flat tubes 24 are included in the header 20. Suitable fins 26 are provided between the tubes 24 to assist in heat exchange, such as the illustrated serpentine fins which are known in the art, The header 20 such as illustrated in FIGS. 1–4 is generally rectangular, with four flanges 30, 32, 34, 36 oriented at generally right angles to the generally flat dimension of the header 20 (i.e., extend generally in the direction of the tubes 24) with the flanges 30–36 oriented in a box-like configuration and connected at the rectangular corners A, B, C, D of the header 20 (flanges 34, 36 are hidden in the perspective view of FIG. 4).

The header 20 is assembled as described in more detailed hereafter with other closure pieces to form a manifold 40 which defines an enclosed space such as is known for handling the flow of fluid from the tubes 24 such as is known in the art. It will be readily recognized that the details of the manifold 40, including specifically the provision of system inlets and outlets, may be designed according to the desired operation of the heat exchanger 18. The description herein is generally of the manifold 40 without reference to such inlets and outlets, which may be suitably provided according to design requirements.

As illustrated, the manifold 40 may be formed by suitable connection of the header 20, a generally U-shaped tank closure 42 having opposite side walls 44, 46, and closure caps 48 on opposite ends (only one cap 48 is shown in the cut off view of FIG. 3; a similar cap is provided as the opposite end of the tank closure 42).

The closure caps 48 may be, as illustrated in FIG. 3, integral with the side plates 50 extending along the length of the tubes 24 and engaging the outermost set of fins 24. The integral closure caps 48 may be offset by a bend 52 from the associated side plate 50 where desired.

The side plates 50 may have longitudinally extending flanges 56 along their length. Further, the closure caps 48 may have longitudinally extending flanges 60 on opposite sides, as well as an end flange 62 for suitable strong connection in forming the manifold 40 as described in more detail hereafter.

Specifically, the header 20 and side plates 50 with closure caps 48 may be cut from a solder-coated aluminum sheet in any suitable fashion. Once cut, they may further be subjected to metal working operations as described hereafter.

In the enlarged detail shown in FIG. 1, it can be seen that three of the closure pieces defining the manifold 40, namely the header 20, one side wall 46 of the tank closure 42, and one closure cap 48 are connected to define a corner of the enclosed space of the manifold 40. Specifically, two of the closure pieces abut one another (corner A of header 20 and the closure cap 48) along a substantially flat portion of the tank closure side wall 46.

As best seen in FIG. 1, the sheet thickness $t_1$ in the portion of the closure cap 48 connected at that corner of the manifold 40 is thicker than the adjacent portions of the closure cap 48 and flange 60. This may be accomplished in any suitable manner, such as with an appropriate pressure or an embossing punch in an appropriately designed lower die, in which the sheet thickness in that area is appropriately reduced. For example, the sheet thickness in that area may be reduced by about ⅓. As a result of the reduced sheet thickness, the general design parameters required for the manifold walls may be maintained while allowing the bent edge 70 joined at the corner of the manifold 40 to be produced with a smaller bending radius than would otherwise be readily obtainable. For example, the bending radius may be preferably no greater than 0.8 mm, whereby a determinable, very small open cross section is formed on the assembled heat exchanger 18 at point P (FIG. 1), which can be closed without problem during subsequent soldering. Further, the side walls 44, 46 of the tank closure 42 may be coated with solder so that a sufficient amount of solder is available in order to close the small open cross section during a suitable heat processing of the assembled closure pieces. Thus, larger open cross section openings can be avoided, enabling the heat exchanger 18 to be manufactured using the modern, more economical and more environmentally safe soldering methods, and the use of obsolete, disfavored soldering methods as might be required to seal a larger open cross section (see FIGS. 2 and 4 in GB 20 98 313) by addition of solder may be avoided.

It should be further mentioned for the FIG. 1 embodiment, the closure caps 48 may be bent slightly relative to side plates 50 (as shown in dashed lines in FIG. 3) in order to facilitate assembly of the heat exchanger, especially pulling of the header 20 onto the ends of flat tubes 24, which may be assembled beforehand with the serpentine fins 26 and side plates 50.

Further, as shown particularly in FIG. 2, the flat tubes 26 and the openings 24 adapted to receive the flat tubes 26 extend substantially the entire header width (i.e., substantially right to the flanges 32, 36 on opposite sides of the header 20). As a result, essentially the entire design depth of the heat exchanger 18 is only slightly larger than the useful design depth for heat exchanger 18, so that the required incorporation space of the heat exchanger 18 in a vehicle, for example, can be utilized very efficiently. The flat tubes 26 also may have no deformations on the ends, which can also contribute to cost-effective manufacture.

As illustrated in FIG. 1, the reduced sheet thickness may also be provided at corner A of the header 20 whereby both abutting pieces (header 20 and closure cap 48) will have a minimal bending radius and thereby a very small open cross section at point P, which may easily and reliably closed with a fluid tight seal by advantageous soldering methods such as are known to product a reliable, sturdy manifold 40.

Figure 5:
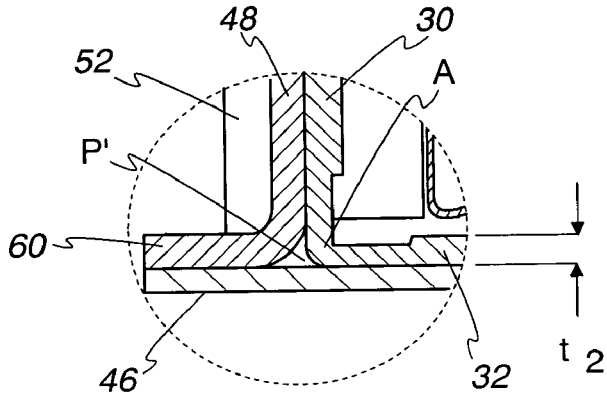
FIG. 5 is a detailed cross-sectional view of a corner region in an alternative embodiment.

Alternatively, as illustrated in FIG. 5, a reduced thickness portion (and resultant minimal bending radius) may alternatively be provided in only one of the abutting closure pieces (e.g., as illustrated in FIG. 5, only the portion at corner A of the header 20 may be provided with a reduced thickness (e.g., $t_1$, as previously noted) which is smaller than the thickness $t_2$ of the adjacent portions such as previously discussed. While the bend radius at the adjacent closure cap 48 will therefore be larger, the open space at point P' between the two closure pieces (header 20 and closure cap 48) may still be sufficiently small to enable use of advantageous solder methods to provide a suitable joint at that corner of the enclosed space defined by the manifold 40.

Figure 6:
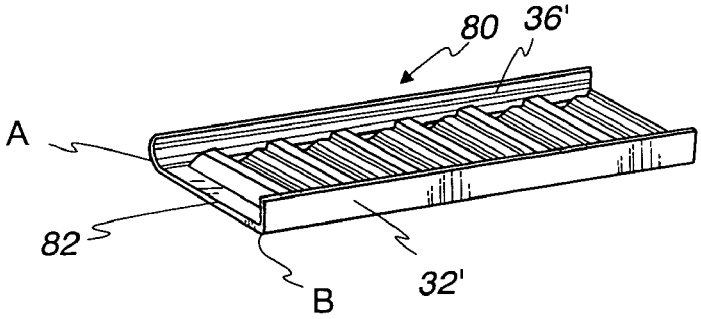
FIG. 6 is a perspective view of another header.
Figure 7:
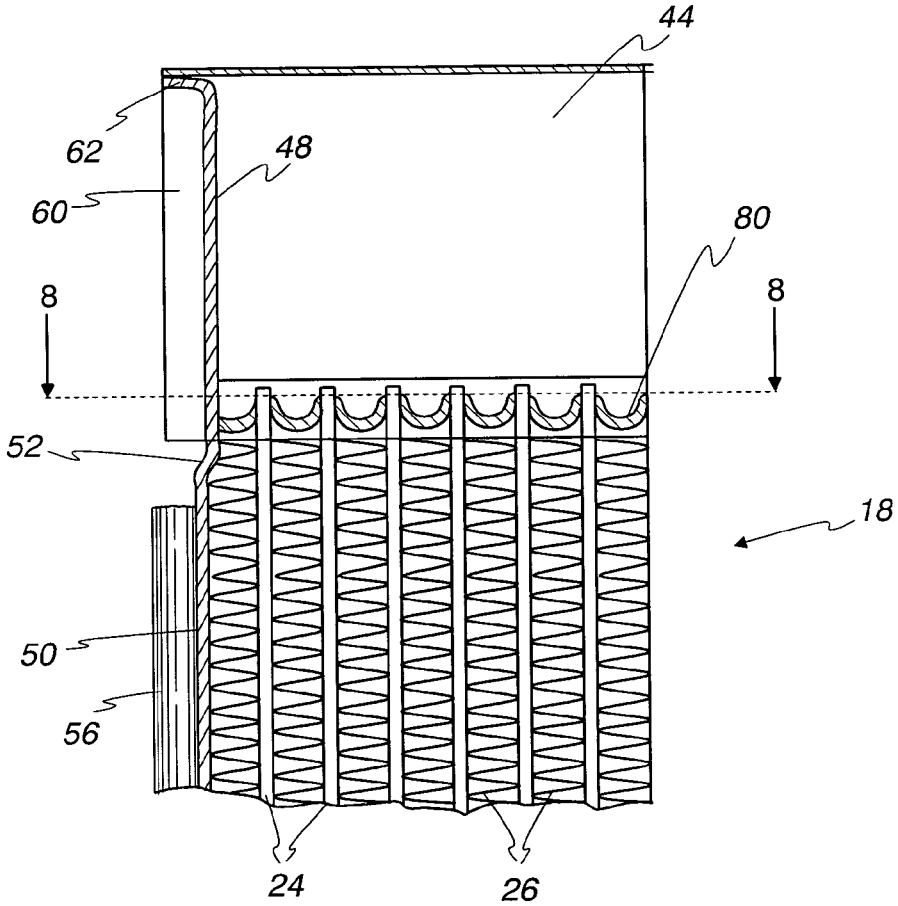
FIG. 7 is a side cross-sectional view taken along line 7—7 of FIG. 8 of a portion of another heat exchanger embodying the present invention, including the FIG. 6 header.
Figure 8:
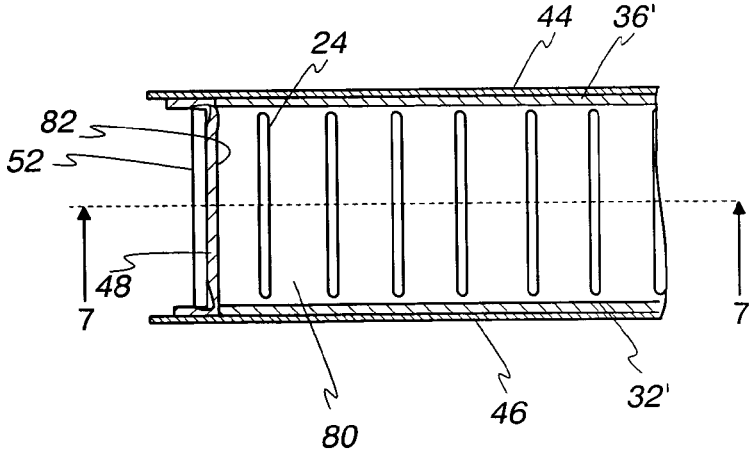
FIG. 8 is a top cross-sectional view of the heat exchanger of FIG. 7, taken along line 8—8 in FIG. 7.

FIGS. 6–8 illustrate another embodiment of the invention, wherein like components are given like reference numerals, and similar but modified components are identified with new numbers. Specifically, the header 80 of the FIGS. 6–8 embodiment has been modified so as to have only two side flanges 32', 36'. No flanges are provided at the ends of the header 80.

As a result, as shown in FIGS. 7 and 8, a seal is provided between the closure cap 48 and the header 20 not via the securement of a header flange against the cap 48 as in FIGS. 1–5, but via the engagement of the end 82 of the header 80 with the cap 48. Given the lack of a bent flange at the end 82 of the header 80, a relatively sharp edge form may be readily provided in the corner regions A, B, C, D of the header 80. With this embodiment, therefore, the portion of the closure cap 48 and flange 60 are suitably provided with a reduced thickness (such as illustrated in FIG. 1), which bent edge 70 is therefore adjacent the square corner A of the header 80, and thereby provides a small open area which may be closed during manufacture by desired soldering methods. With this embodiment, the sheet thickness of the header 80 may be about 1.5 mm, which this thickness may be sufficient to guarantee a firm and tight solder connection with the closure caps 48 and side walls 44, 46 of the tank closure 42.

Figure 9:
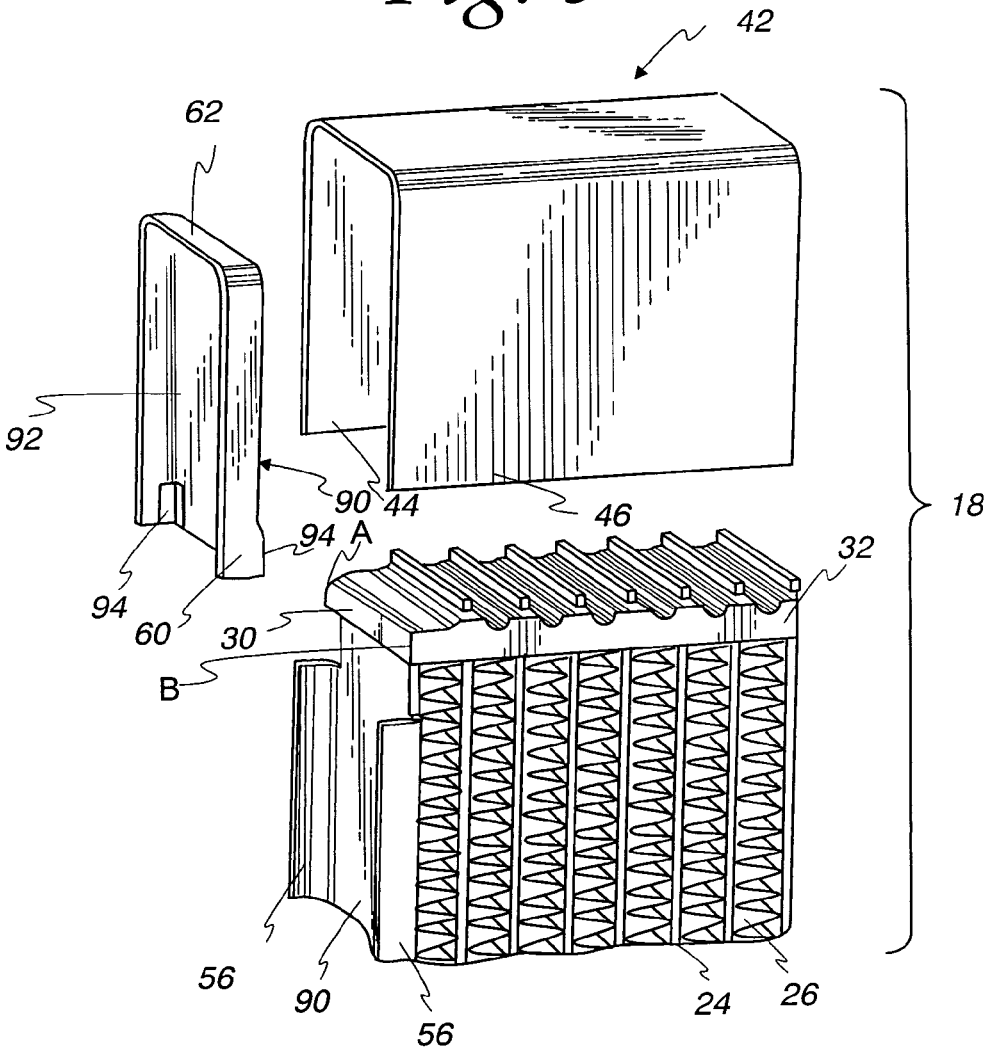
FIG. 9 is an exploded perspective view of a portion of a heat exchanger according to a third embodiment of the invention.

FIG. 9 illustrates yet another embodiment incorporating the present invention. In the FIG. 9 embodiment, the side plates 90 are separate from the closure cap 92, and may be advantageously secured on their end on the inner side of the flanges 30, 34 at the ends of the header 20.

The closure caps 92 (only one of which is shown in FIG. 9) include thinner portions 94 at their bent edges adjacent the corners A, B of the header 20, whereby a small diameter bending radius may be provided and a small opening between the adjacent closure pieces provided which may be suitably closed by desired solder methods.

Figure 10A:
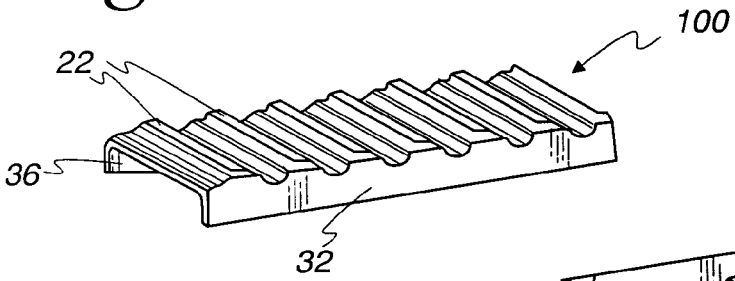
FIGS. 10*a* and 10*b* are perspective views of still further headers which may be used with the present invention.
Figure 10B:
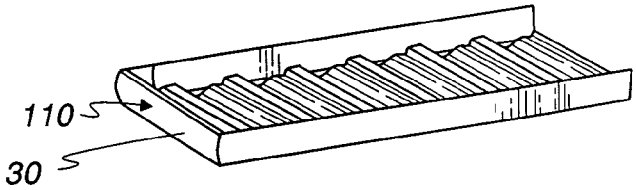

FIGS. 10*a*–10*b* illustrate still other embodiments of headers which may be advantageously used with the present invention. For example, header 100 in FIG. 10*a* is similar to the header 80 of FIG. 6, but with the two side flanges 32, 36 directed in opposite directions. Header 110 in FIG. 10*b* is similar to the header in FIG. 6 but with added flanges 30 on opposite ends (only one is shown in FIG. 10*b*).

Figure 11:
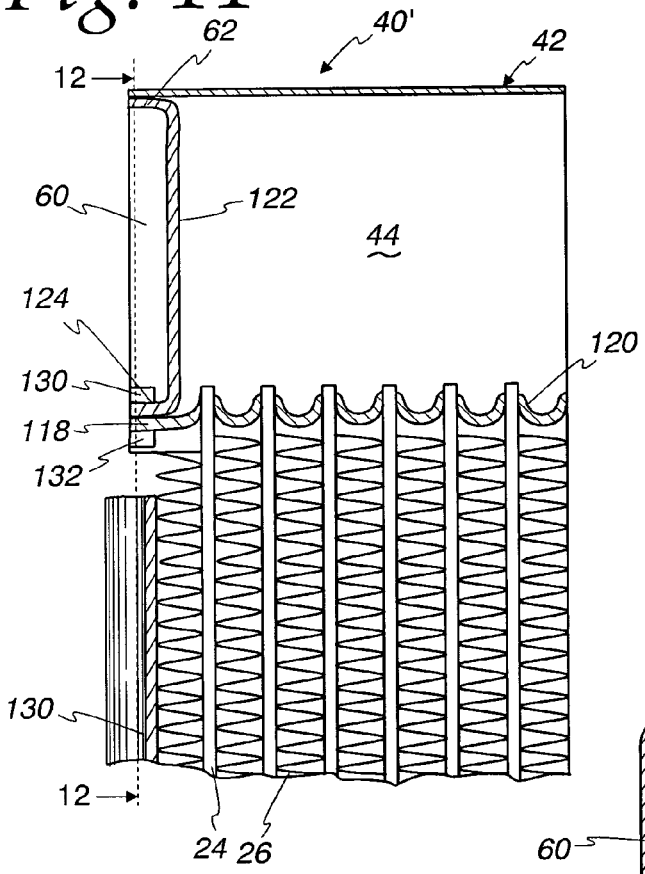
FIG. 11 is a side cross-sectional view taken along line 11—11 of FIG. 12 of a portion of another heat exchanger embodying still another embodiment of the present invention.
Figure 12:
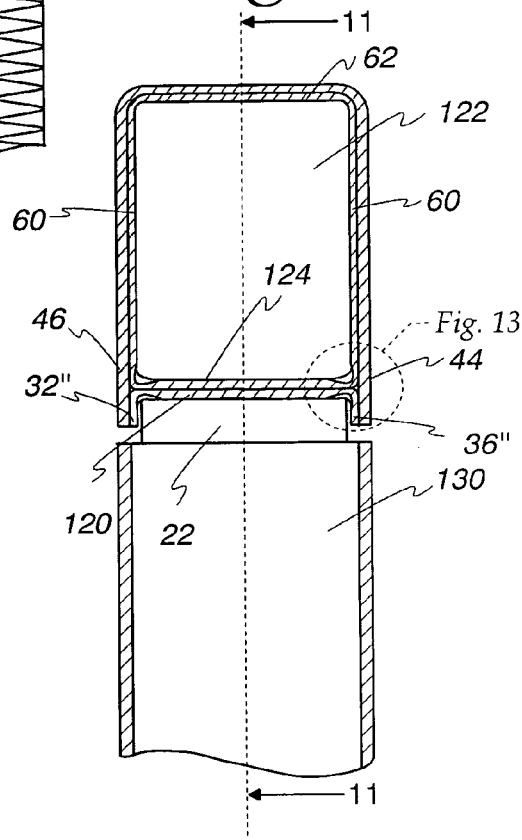
FIG. 12 is an end cross-sectional view of the heat exchanger of FIG. 11, taken along line 12—12 of FIG. 11.
Figure 13:
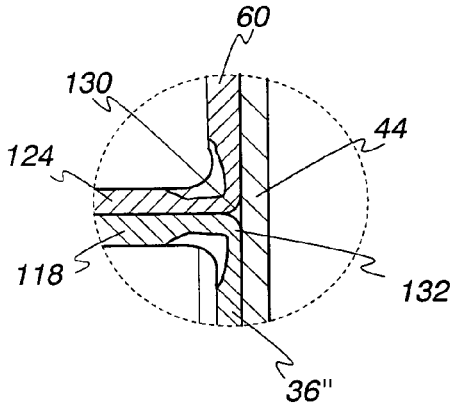
FIG. 13 is a detailed cross-sectional view of a corner region of the FIGS. 11–12 embodiment.

FIGS. 11–13 illustrate yet another embodiment incorporating the present invention, wherein the ends 118 of the header 120 extend further outwardly than the previously described embodiments, and the side flanges 32", 36" of the header 120 extend down like the FIG. 10*a* embodiment. Further, the bottom portion of the closure cap 122 has a flange 124 which abuts the header end 118, such that the closure cap 122 is separate from the side plate 130 adjacent the fins 26.

With this structure, the closure cap 122 has a flange running around its entire periphery, allowing for excellent connections to the tank closure 42 and the header 120. It is unimportant whether the cap flange (60, 62, 124) is directed outward, as shown, or inward into the formed manifold 40'.

Moreover, it should be appreciated that the FIGS. 11–13 embodiment will, as with the previously described embodiment, include corners defined in the manifold 40' which will have two of the closure pieces (header 120 and closure cap 122) abutting one another along a flat portion of a third closure piece (tank closure side wall 42), as best shown in FIG. 13. Thus, the bent edges at such corners may be advantageously provided in relatively thin portions 130, 132, whereby a small open space will provided therebetween which may be securely sealed with advantageous soldering methods such as previously described herein. One such corner is illustrated in FIG. 13, but it should be appreciated that all corners defined by the joining of three connecting pieces such as described may advantageously use the described structure with relatively thin portions.

Figure 14A:
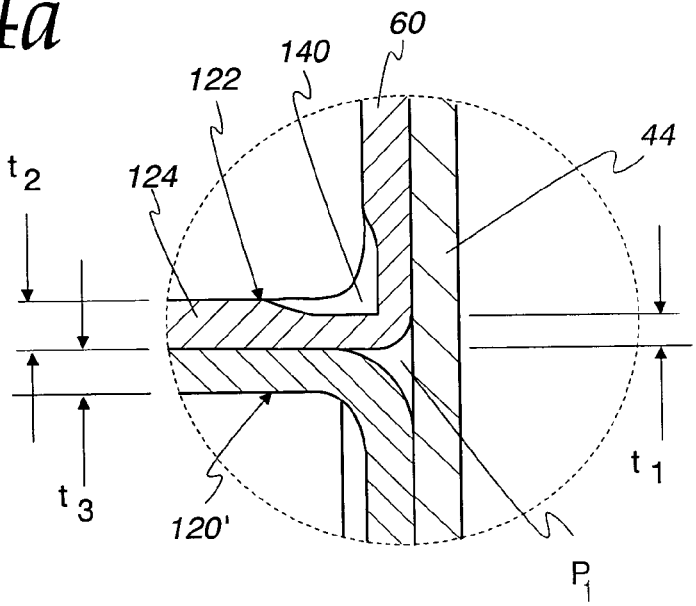
FIGS. 14*a* and 14*b* are detailed cross-sectional views of a corner region of a manifold, showing representative alternate structures which may be used within the scope of the present invention.
Figure 14B:
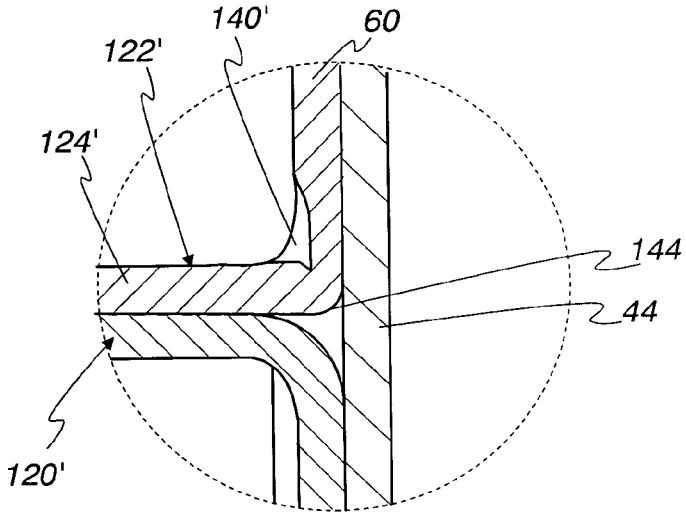
Figure 15A:
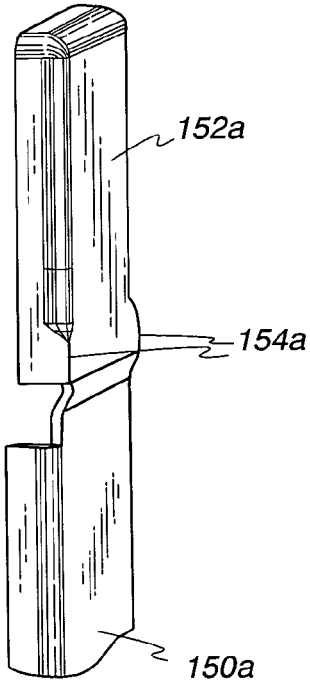
FIGS. 15*a*, 15*b*, 15*c*, 15*d* and 15*e* show five representative alternate embodiments of side plates and closure caps which may be used within the scope of the present invention.
Figure 15B:
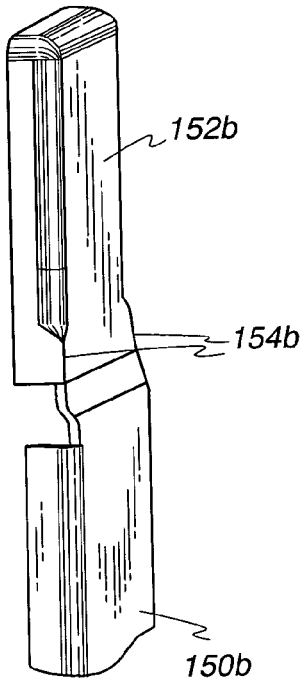
Figure 15C:
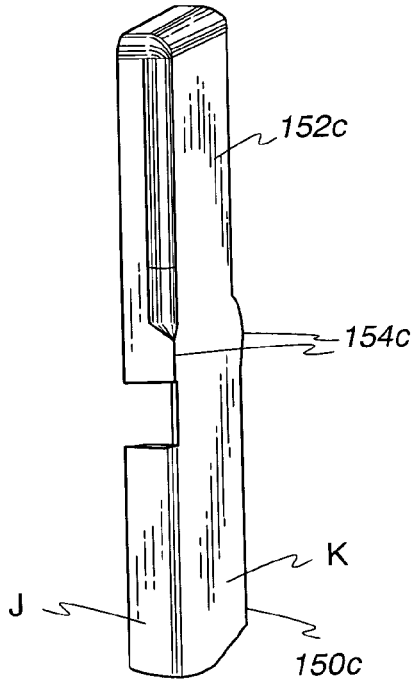
Figure 15D:
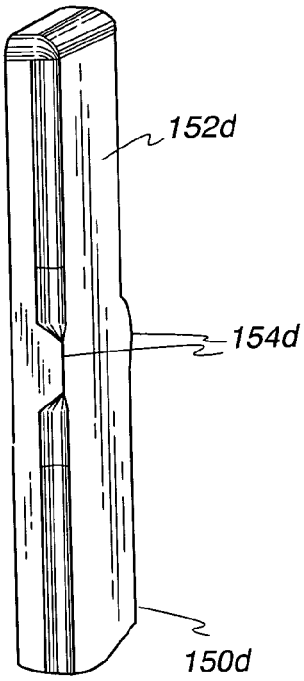
Figure 15E:
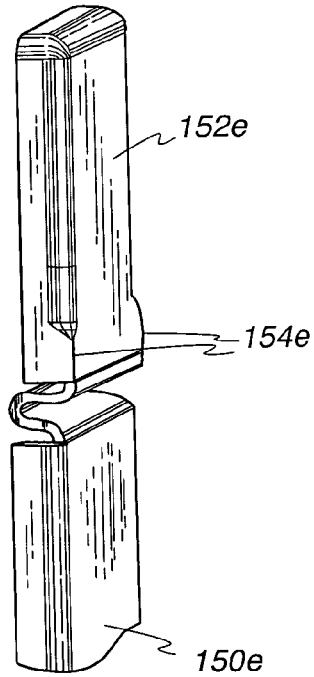

FIGS. 14*a*–14*b* show details, similar to FIGS. 1, 5 and 13, of the connection of three closure pieces wherein only one of the pieces is provided with a thin portion.

For example, in FIG. 14*a*, a corner such as in FIG. 13 is shown wherein only the closure cap 122 has a thin portion 140, with the header 120' having no thin portion. As illustrated, the adjacent portions of the closure cap 122 have a thickness of $t_2$, with the thin portion having a thickness of $t_1$. The thickness $t_3$, of the header 120' may be substantially similar to the general thickness $t_2$ of the closure cap 122, and the thin portion 140 may have a thickness $t_1$, on the order of ⅔ of $t_2$ (i.e., reduced by about ⅓). It should be appreciated, however, that the thin portion may be reduced to the limit of what is feasible in terms of manufacture, although one skilled in the art will recognize that it is not necessary to reduce the thickness to something significantly less than (and thereby potentially significantly weaker than) necessary to enable the formation of a bent edge having the radius necessary to enable advantageous assembly as discussed herein.

It can be readily seen in FIG. 14*a*, for example, that the larger bending radius on the header 120' resulting from the thicker material at the bend will result in a larger open cross section at point $P_1$ between the closure pieces 44, 60, 120'. However, where the total open cross section is still sufficiently small (due to the smaller open cross section resulting from the closure cap 140 having the small outer diameter due to the thin portion 140 at the bent edge) to ensure that a suitable, fluid tight connection will be formed at that corner of the manifold by use of desired and advantageous soldering methods in manufacture, then merely one thin portion may be provided at the corner as illustrated.

FIG. 14*b* similarly illustrates the provision of only one thin portion at the corner, and is essentially the same as the structure illustrated in FIG. 14*a* except that the thin portion 140' may be smaller and need not necessarily extend uniformly on both sides of the bent edge 144 (i.e., does not necessarily require a thin portion in flange 124' which is equal to that in flange 60 of closure cap 122').

In short, it should be appreciated that the present invention incorporates a wide variety of structures containing thin portions enabling the bending radius of the closure piece at the described corners to be reduced so as to close the open cross section at such corners to allow use of advantageous solder methods to securely close the open cross section. Variations as to which bent edges may be formed as described herein may be selected dependent upon the individual case, that is, on how much solder is available in the corner region and whether the solder supply is sufficient to properly close the remaining gap.

FIGS. 15*a*–*e* illustrate five different embodiments of integral side plates 150*a*–*e* and closure caps 152*a*–*e* which may be used with different heat exchangers and header constructions. Various portions of the closure caps may be thinned in accordance with the present invention to provide a small bend radius at desired corners such as indicated generally at 154*a*–*e* in each of the embodiments. As illustrated in the various embodiments, the closure caps 152*a*–*e* may be aligned with, or offset in or out, relative to the side plates 150*a*–*e*. Further, cut out portions may be provided in the side flanges of each. Still further, the integral structure may be configured so as to permit expansion under the influence of temperature fluctuations.

With an understanding of the above, it should be appreciated that manufacture of heat exchangers embodiments incorporating the present invention may be accomplished by suitably assembling closure pieces wherein, in at least one corner of the manifold defined by the connected joint of three closure pieces, (1) a thin portion of at least one closure piece is formed with a sheet thickness which is less than the sheet thickness of the adjacent portions, (2) the closure piece thin portion is deformed to form a first bent edge, and (3) the closure pieces are connected to form the manifold, wherein the formed bent edge abuts an end of a second of the closure pieces adjacent a generally flat section of a third of the closure pieces. The connecting step may be readily accomplished via suitable heading of solder coated aluminum sheets forming at least one of the closure pieces, where the solder is caused to bond the components and provide a fluid tight seal, including at the defined corner.

Still other aspects, objects, and advantages of the present invention can be obtained from a study of the specification, the drawings, and the appended claims. It should be understood, however, that the present invention could be used in alternate forms where less than all of the objects and advantages of the present invention and preferred embodiment as described above would be obtained.

What is claimed is:

1. A heat exchanger for vehicles, including a plurality of flat tubes communicating with an enclosed space defined by a plurality of connected closure pieces, said plurality of tubes having open ends secured to and extending through tube openings in one of said closure pieces, comprising a first corner of said defined space defined by the connected joint of three of said closure pieces where a first of said closure pieces has a first bent edge abutting an end of a second of said closure pieces adjacent a generally flat section of a third of said closure pieces, wherein said first bent edge of said first closure piece adjacent said first corner comprises a bend in a thin portion of said first closure piece having a sheet thickness which is less than the sheet thickness of the adjacent portions of said first closure piece on opposite sides of said bend.

2. The heat exchanger of claim 1, wherein said first bent edge comprises a flange at generally right angles to a wall member of said first closure piece which defines a side of said defined space, and said flange is generally aligned with said generally flat section of said third closure piece.

3. The heat exchanger of claim 1, wherein said one of said closure pieces is a header.

4. The heat exchanger of claim 1, wherein said plurality of connected closure pieces comprise a manifold.

5. The heat exchanger of claim 1, wherein said closure pieces are aluminum with a fluid tight seal at said first corner formed by solder.

6. A heat exchanger for vehicles. including a plurality of flat tubes communicating with an enclosed space defined by a plurality of connected closure pieces, said plurality of tubes having open ends secured to and extending through tube openings in one of said closure pieces, comprising a first corner of said defined space defined by the connected joint of three of said closure pieces where a first of said closure pieces has a first bent edge abutting an end of a second of said closure pieces adjacent a generally flat section of a third of said closure pieces, wherein said first bent edge of said first closure piece adjacent said first corner comprises a bend in a thin portion of said first closure piece having a sheet thickness which is less than the sheet thickness of the adjacent portions of said first closure piece, and wherein said one of said closure pieces include four side flanges extending generally in the direction of said tubes, wherein at least two of said flanges join at said first bent edge.

7. A heat exchanger for vehicles, comprising a plurality of flat tubes communicating with an enclosed space defined by a plurality of connected closure pieces, said plurality of tubes having open ends secured to and extending through tube openings in one of said closure pieces, comprising a first corner of said defined space defined by the connected joint of three of said closure pieces where a first of said closure pieces has a first bent edge abutting an end of a second of said closure pieces adjacent a generally flat section of a third of said closure pieces, wherein said first bent edge of said first closure piece adjacent said first corner comprises a bend in a thin portion of said first closure piece having a sheet thickness which is less than the sheet thickness of the adjacent portions of said first closure piece, and second, third and fourth corners of said defined space each defined by the connected joint of three of said closure pieces, wherein:

said first closure piece includes four side flanges extending generally in the direction of said tubes and joined in a rectangular configuration with said first bent edge and second, third and fourth bent edges at the joining of the side flanges;

said second corner is defined by a connected joint of three of said closure pieces, one of which is said second bent edge of said first closure piece;

said third corner is defined by a connected joint of three of said closure pieces, one of which is said third bent edge of said first closure piece;

said fourth corner is defined by a connected joint of three of said closure pieces, one of which is said fourth bent edge of said first closure piece; and said second, third and fourth bent edges of said first closure piece each comprise a bend in a thin portion of said first closure piece having a sheet thickness which is less than the sheet thickness of the adjacent portions of said first closure piece.

8. The heat exchanger of claim 7, wherein said first closure piece is a header.

9. The heat exchanger of claim 8, wherein said second closure piece is a first closure cap and said third closure piece is a tank closure, and further comprising a second closure cap, wherein said first and second corners are defined by connected joints of said header, said first closure cap and said tank closure and said third and fourth corners are defined by connected joints of said header, said second closure cap and said tank closure.

10. The heat exchanger of claim 9, wherein two of said four side flanges on opposite ends of said first closure piece are fluid tight sealed to said first and second closure caps, respectively, along their length;

the other two of said four side flanges are fluid tight sealed to said tank closure along their length; and said tank closure and said side flanges are fluid tight sealed.

11. A heat exchanger for vehicles, including a plurality of flat tubes communicating with an enclosed space defined by a plurality of connected closure pieces, said plurality of tubes having open ends secured to and extending through tube openings in one of said closure pieces, comprising a first corner of said defined space defined by the connected joint of three of said closure pieces where a first of said closure pieces has a first bent edge abutting an end of a second of said closure pieces adjacent a generally flat section of a third of said closure pieces, wherein said first bent edge of said first closure piece adjacent said first corner comprises a bend in a thin portion of said first closure piece having a sheet thickness which is less than the sheet thickness of the adjacent portions of said first closure piece, and wherein said first bent edge at said thin portion of said first closure piece has an outer bending radii of 0.8 mm or less.

* * * * *